US011598616B1

(12) United States Patent
Beal

(10) Patent No.: US 11,598,616 B1
(45) Date of Patent: Mar. 7, 2023

(54) VENTED HOLLOW POINT PROJECTILE

(71) Applicant: Lone Star Future Weapons, LLC, Garland, TX (US)

(72) Inventor: Harold F. Beal, University Park, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

(21) Appl. No.: 17/467,512

(22) Filed: Sep. 7, 2021

(51) Int. Cl.

| | |
|---|---|
| ***F42B 12/34*** | (2006.01) |
| ***F42B 10/46*** | (2006.01) |
| ***F42B 12/78*** | (2006.01) |
| *F42B 10/44* | (2006.01) |

(52) U.S. Cl.
CPC ..... *F42B 12/34* (2013.01); *F42B 10/46* (2013.01); *F42B 12/78* (2013.01); *F42B 10/44* (2013.01)

(58) Field of Classification Search
CPC ..... F42B 12/34; F42B 30/02; F42B 10/46; F42B 10/44; F42B 12/78
See application file for complete search history.

(56) References Cited

U.S. PATENT DOCUMENTS

| | | | | | |
|---|---|---|---|---|---|
| 627,929 | A * | 6/1899 | Andrews | F42B 14/04 | 102/511 |
| 4,128,060 | A * | 12/1978 | Gawlick | F42B 10/34 | 102/529 |
| 5,275,110 | A * | 1/1994 | Flatau | F42B 30/02 | 102/509 |
| 8,881,654 | B2 * | 11/2014 | Seecamp | F42B 12/36 | 102/508 |
| 11,268,791 | B1 * | 3/2022 | Frees | F42B 12/78 | |
| 2002/0056397 | A1 * | 5/2002 | Carr | F42B 12/34 | 102/509 |
| 2008/0196616 | A1 * | 8/2008 | Cziglenyi | F42B 12/34 | 102/517 |
| 2013/0092041 | A1 * | 4/2013 | Seecamp | F42B 30/02 | 102/501 |
| 2018/0313639 | A1 * | 11/2018 | Peterson | F42B 12/74 | |

FOREIGN PATENT DOCUMENTS

| | | | | |
|---|---|---|---|---|
| GB | 2602050 | A * | 6/2022 | F42B 12/382 |
| WO | WO-2009111654 | A1 * | 9/2009 | F42B 12/34 |
| WO | WO-2018218292 | A1 * | 12/2018 | F42B 10/02 |

* cited by examiner

*Primary Examiner* — Jonathan C Weber
(74) *Attorney, Agent, or Firm* — Burdick Patents, P.A.; Sean Burdick

(57) ABSTRACT

A projectile for use in a firearm ammunition cartridge, and a method of forming the projectile the projectile including a core, a jacket in which the core is disposed, the jacket having a closed rearward end and an open forward end, the forward end tapering inwardly toward a longitudinal centerline of the jacket to define an ogive portion of the projectile, and extending past a forward end of the core to form an open space inside the jacket between the forward end of the core and the forward end of the jacket, and a plurality of ventilation ports formed proximate the forward end of the jacket, each of the ventilation ports having a first opening on an inner surface of the jacket defining the open space, and a second opening on an outer surface of the jacket.

17 Claims, 7 Drawing Sheets

VENTED HOLLOW POINT PROJECTILE

CROSS-REFERENCE TO RELATED APPLICATIONS

Not applicable.

FIELD OF INVENTION

The present general inventive concept relates to firearm ammunition and methods of manufacture thereof, and, more particularly, to hollow point firearm ammunition with a vented tip.

BACKGROUND

Ammunition cartridges of the type commonly used in modern firearms are generally known in the art. An ammunition cartridge typically includes a generally cylindrical case which is sized and shaped to correspond to the interior of a firing chamber of a firearm. The case includes an open leading end having a projectile held therein. When the cartridge is received within the chamber, the leading end of the case carrying the projectile faces toward and along the bore of the firearm.

Lead, compacted metal powders, etc., are typically loaded into a jacket, such as a cup-shaped copper metal jacket. The core in the jacket is seated against the closed end of the jacket ("core seating"), and the open end of the jacket is formed about the core and shaped to define an aerodynamically desirable leading end of the projectile. For purposes of at least partially closing the open end of the jacket while defining the desired aerodynamic shape on that end of the core/jacket combination which will become the leading end of the projectile when it is fired from a gun, the core is chosen to be shorter in length than the depth of the jacket so that there is a portion of the jacket wall adjacent the open end of the jacket which is void of core material when the seating operation has been completed.

Core seating may take place with the core/jacket combination being held in a die while pressure is applied axially of the core to seat the core within the closed end of the jacket, and, in part, to the side wall of the jacket. Thereafter, and usually in a different die, the open end of the jacket is formed inwardly toward the longitudinal centerline of the jacket. This operation may take place in steps, and may involve more than one die, but in the end, the initially open end of the jacket is closed to the extend desired. The initially open end of the jacket may be fully closed or partially closed, in part depending upon the desired terminal ballistics of the projectile.

In certain projectiles, it may be desired that the projectile substantially disintegrate upon striking a target, often disintegrating only after limited penetration into a target. Maximum disintegration in these projectiles is desired, including maximum disintegration of the jacket into very small fragments, and disintegration of the powder-based core into particulates which are on the order of the individual particle size of the powder employed in forming the core. Disintegration of a jacketed projectile, even projectiles formed from lead cores, is known to be enhanced through the use of a "hollow point" at the leading end of the jacketed projectile. However, hollow pointed projectiles suffer from several shortcomings, such as their relatively inefficient aerodynamic effect upon the flight of the projectile to a target, and other ill effects, all of which must be balanced against the requirement that the projectile disintegrate to the fullest extent upon striking a target. As the hollow point of the leading end of the projectile is essentially a closed pocket which greatly increases wind resistance, the turbulence created by that configuration can greatly affect the speed and/or path of the round.

As such, there exists a desire to provide a hollow point round which will maximize disintegration of the round upon impact, but also improve the wind resistance of the round and decrease turbulence created during the flight of the round.

BRIEF SUMMARY

According to various example embodiments of the present general inventive concept, a firearm ammunition projectile is provided with ventilation ports to allow air to pass therethrough during flight of the round to decrease turbulence.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a projectile for use in a firearm ammunition cartridge, the projectile including a core, a jacket in which the core is disposed, the jacket having a closed rearward end and an open forward end, the forward end tapering inwardly toward a longitudinal centerline of the jacket to define an ogive portion of the projectile, and extending past a forward end of the core to form an open space inside the jacket between the forward end of the core and the forward end of the jacket, and a plurality of ventilation ports formed proximate the forward end of the jacket, each of the ventilation ports having a first opening on an inner surface of the jacket defining the open space, and a second opening on an outer surface of the jacket.

The foregoing and/or other aspects and advantages of the present general inventive concept may also be achieved by providing a method of forming a projectile for use in a firearm ammunition cartridge, the method including providing a jacket having a closed rearward end and an open forward end, disposing a core inside the jacket, tapering the forward end of the jacket inwardly toward a longitudinal centerline of the jacket to define an ogive portion of the projectile such that the forward end of the jacket extends past a forward end of the core to form an open space inside the jacket between the forward end of the core and the forward end of the jacket, and forming a plurality of ventilation ports in the forward end of the jacket, each of the ventilation ports having a first opening on an inner surface of the jacket defining the open space, and a second opening on an outer surface of the jacket.

The foregoing and/or other aspects and advantages of the present general inventive concept may also be achieved by providing a projectile for use in a firearm ammunition cartridge, the projectile including a core, a jacket in which the core is disposed, the jacket having a closed rearward end and an open forward end, the forward end tapering inwardly toward a longitudinal centerline of the jacket to define an ogive portion of the projectile, and extending past a forward end of the core to form an open space inside the jacket between the forward end of the core and the forward end of the jacket, and a plurality of ventilation ports formed proximate the forward end of the jacket, each of the ventilation ports having a first opening on a surface defining the open space, and a second opening on an outer surface of the jacket.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these 20 example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a firearm ammunition projectile is provided with ventilation ports to allow air to pass therethrough during flight of the round. Various example embodiments provide an ammunition projectile with holes drilled, or otherwise formed, between the side walls of the projectile jacket and the interior of the hollow point of a hollow point round to reduce wind turbulence at the nose of the projectile, thus improving the flight characteristics of the round.

Figure 1B:
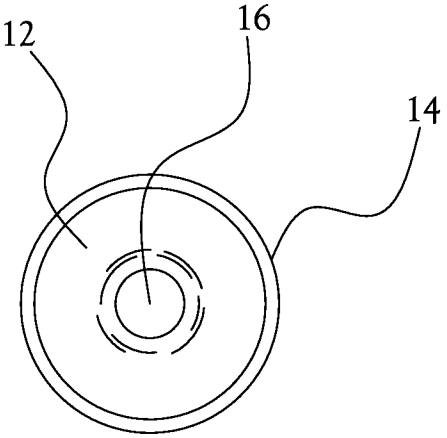
Fig. 1B (PRIOR ART)
FIG. 1B illustrates a front end view of the cartridge of FIG. 1.
Figure 1A:
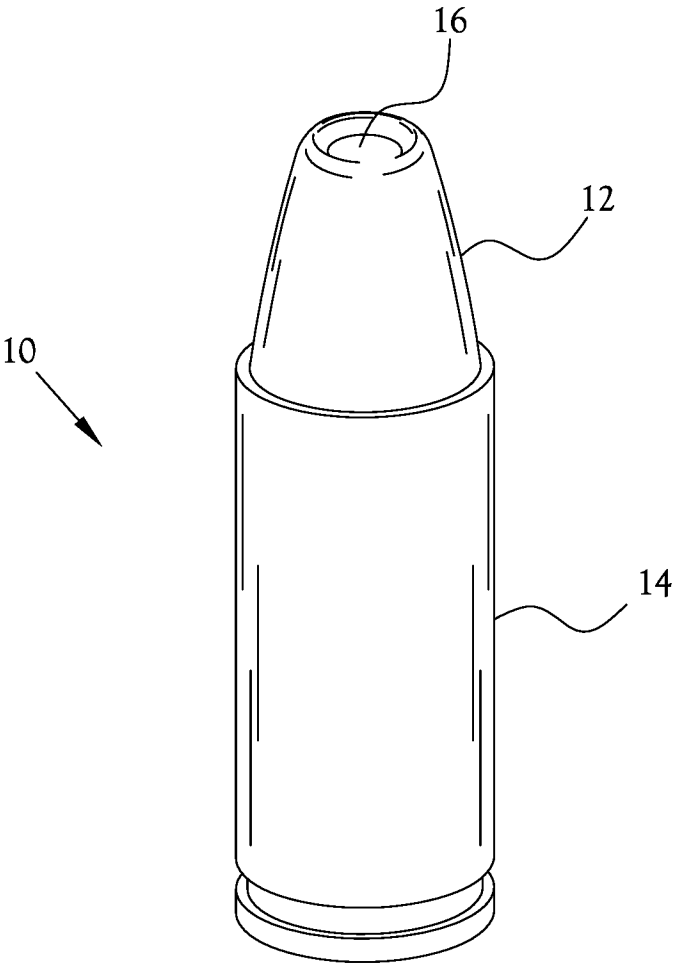
Fig. 1A (PRIOR ART)
FIG. 1A illustrates a perspective view of a conventional firearm cartridge having a hollow point.

FIG. 1A illustrates a perspective view of a conventional firearm cartridge having a hollow point, and FIG. 1B illustrates a front end view of the cartridge of FIG. 1. The conventional cartridge 10 has a jacketed projectile 12 disposed in a casing 14, and terminates in a hollow point tip 16. The hollow point tip 16 may be formed by any of a host of different methods, such as by bending back a portion of the jacket into the hollow space of the hollow point tip 16, which result in the "pocket" formed in the hollow point tip 16. As previously discussed, air encountered during flight moves into the closed pocket to cause turbulence and affect flight characteristics.

Figure 2B:
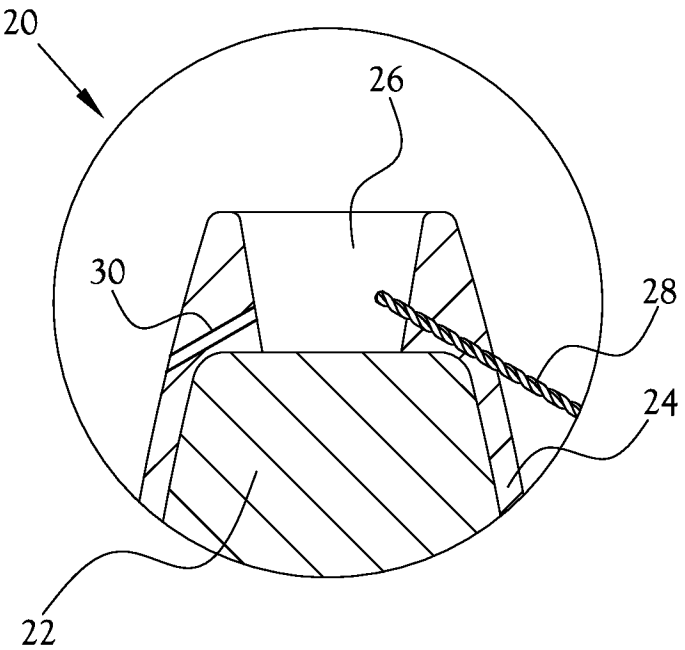
FIG. 2B illustrates a close-up view of the tip the hollow point projectile of FIG. 2A with ventilation ports being formed according to an example embodiment of the present general inventive concept.
Figure 2A:
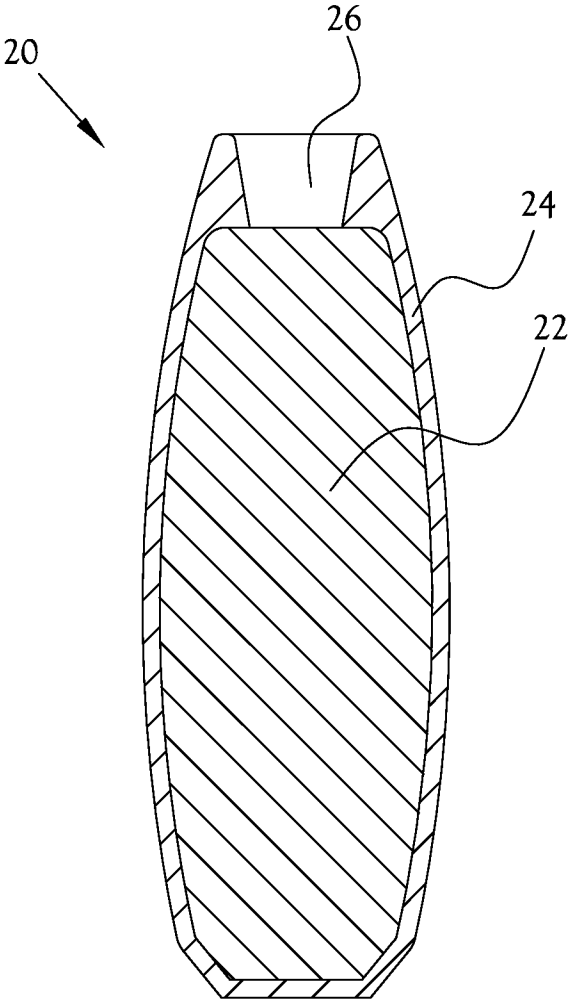
FIG. 2A illustrates a cross section of a hollow point projectile before the formation of ventilation ports.
Figure 3B:
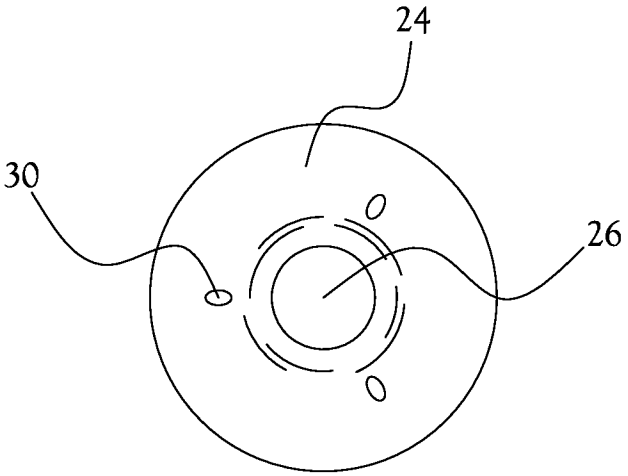
FIGS. 3A-3C illustrate front end views of firearm projectiles formed according to various different example embodiments of the present general inventive concept.
Figure 3A:
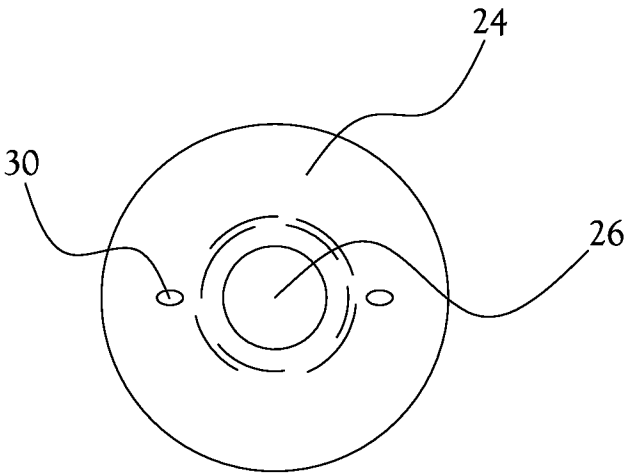
Figure 3C:
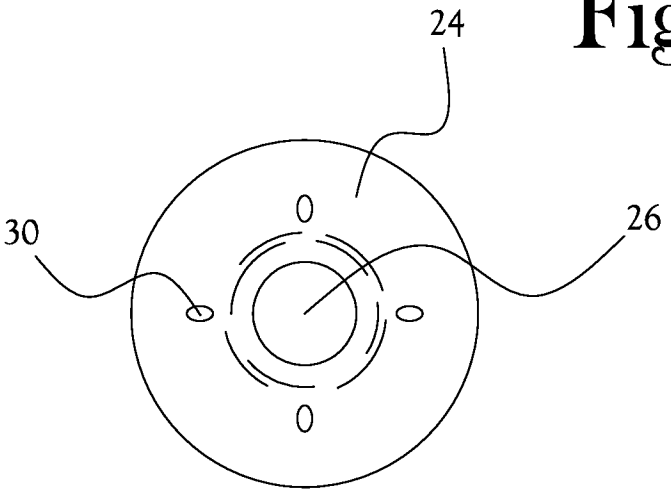

FIG. 2A illustrates a cross section of a hollow point projectile before the formation of ventilation ports, and FIG. 2B illustrates a close-up view of the tip the hollow point projectile of FIG. 2A with ventilation ports being formed according to an example embodiment of the present general inventive concept. In the example embodiment illustrated in FIG. 2A, an initial form of the projectile 20 is formed by seating a core 22 in a jacket 24, and forming the jacket 24 into the desired shape. This may include forming the base of the projectile 20 into, for example, a flat or boat tail configuration, and may also include tapering the leading end of the jacket 24 into a tapered ogive portion of the cartridge 20. Various example embodiments may provide a core 22 that is formed of lead, pressed powders, etc., and a substantially cylindrical jacket 24 that is formed of one or more metals, such as copper, or even synthetic alloys, the jacket 24 being harder than the core 22. As illustrated in FIG. 2A, the jacket 24 extends past the forward end of the core 22 to form a hollow space 26, which may be referred to herein as an open space 26, in the forward end of the projectile 20 that characterizes the projectile as a hollow point round. In FIG. 2B a drill 28 is used to form a plurality of through holes that may be referred to herein as ventilation ports 30 that allow air to pass into the open space 26 and out through a side of the jacket 24 during flight of the projectile 20. Various different example embodiments may include various different numbers of ventilation ports 30 in various different configurations and angles. While it is possible to form example embodiments with a single ventilation port 30, such a configuration may have the unintended consequence of further affecting flight trajectory. As such, various example embodiments of the present general inventive concept may provide a plurality of ventilation ports 30 which are arranged so as to be equidistantly arranged around a longitudinal axis of the projectile 20. FIGS. 3A-3C illustrated front end views of firearm projectiles formed according to various different example embodiments of the present general inventive concept. As illustrated in FIG. 3A, a pair of ventilation ports 30 are provided on opposite sides from one another, in FIG. 3B three ventilation ports 30 are provided that are equidistant from one another around the center axis of the projectile 20, and in FIG. 3C four ventilation ports 30 are provided that are equidistant from one another around the center axis. It is understood that various other quantities of ventilation ports 30 may be formed without departing from the scope of the present general inventive concept. Also, different configurations may be employed, such as two pairs of ventilation ports 30 in which a first pair are fairly close to one another on one side of the open space 26, and a second pair is formed on the opposite side of the open space 26 in a mirrored arrangement relative to the first pair. In various example embodiments, any even number of ventilation ports 30 may be arranged so as to be symmetrical about a longitudinal axis of the projectile 20. Also, while the ventilation ports 30 are illustrated in FIG. 2B as being formed by a drill bit, it is understood that various other methods or tools may be used to form the ventilation ports 30 without departing from the scope of the present general inventive concept. For example, various embodiments may employ a mechanical punch, a laser, etc., to form the ventilation ports through the jacket walls, and in some embodiments the bullet core itself.

As illustrated in FIG. 2B, the ventilation ports 30 may be formed at an angle relative to a longitudinal axis of the projectile 20 such that the ventilation ports 30 are angled back from a forward end of the projectile 20. Various example embodiments of the present general inventive concept may provide a host of differently angled ventilation ports 30. Additionally, different ventilation ports 30 in the same projectile 20 may be formed at different angles, but it may be beneficial to have symmetrical arrangements about the longitudinal axis of the projectile 20 for an improved flight path of the projectile 20. Also, while the example embodiment illustrated in FIG. 2*b* shows the ventilation ports 30 starting at a first opening on an inner surface of the jacket 24 forming the open space 26, and ending at a second opening on an outer surface of the jacket 24, various other example embodiments may be formed with ventilation ports that pass at least partially through the core 22. Various other example embodiments may even have the first opening of one or more of the ventilation ports 30 located on the core 22, with the second opening formed on the outer surface of the jacket 24, and the second opening may be formed on a back half of the jacket 24. Also, while the open space 26 illustrated in FIG. 2B is generally formed by folding back an forward end portion of the jacket 24, a host of differently configured hollow points, such as that illustrated herein in FIG. 5, may be utilized without departing from the scope of the present general inventive concept.

Figure 4A:
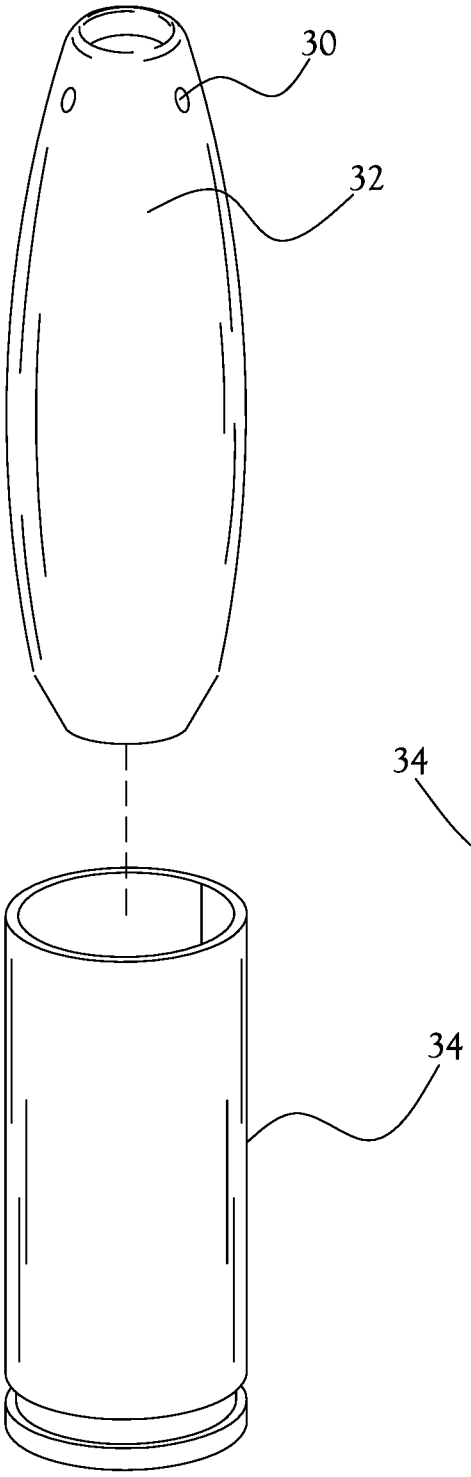
FIG. 4A illustrates a projectile formed according to an example embodiment of the present general inventive concept being disposed in a cartridge casing.
Figure 4B:
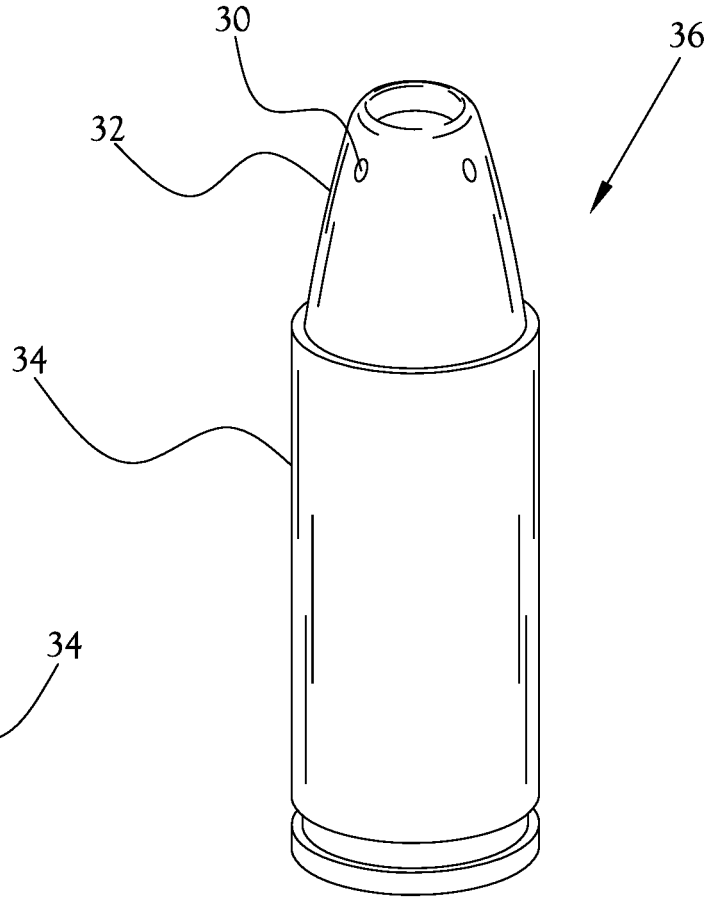
FIG. 4B illustrates a perspective view of the firearm cartridge being formed in FIG. 4A.
Figure 5:
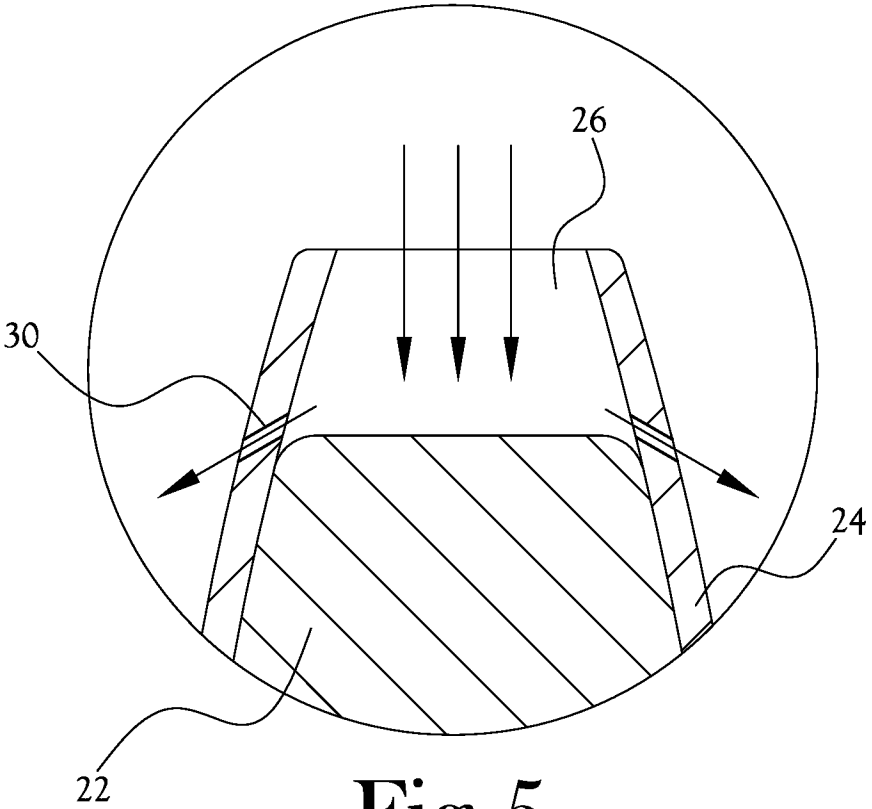
FIG. 5 illustrates air flow through the hollow point of a projectile formed according to an example embodiment of the present general inventive concept.

FIG. 4A illustrates a projectile 32 formed according to an example embodiment of the present general inventive concept being disposed in a cartridge casing 34, and FIG. 4B illustrates a perspective view of the firearm cartridge 36 being formed in FIG. 4A. As illustrated in FIGS. 4A-4B, the resulting hollow point cartridge 36 has ventilation ports 30 to allow more aerodynamic flight of the projectile 32. FIG. 5 illustrates air flow through the hollow point of a projectile formed according to an example embodiment of the present general inventive concept. As illustrated in FIG. 5, air flowing into the hollow space 26 of the hollow point projectile 32 is vented through the ventilation ports 30, decreasing turbulence and wind resistance encountered by the projectile 32 during flight.

Figure 7:
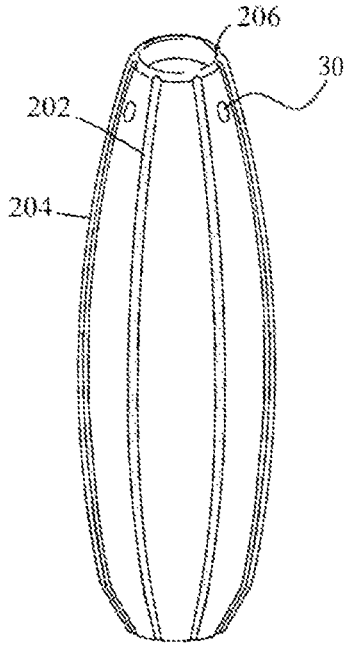
FIG. 7 illustrates a perspective view of an alternative embodiment of a projectile according to the present inventive concept having rib cuts defined in an outer surface of the jacket.

FIG. 7 is a perspective view of an alternate embodiment of a ventilated projectile 200 having a plurality of rib cuts 202 defined in the outer surface of the jacket 204. The rib cuts 202 are designed to facilitate the expansion of the projectile 200 upon impact with a target. The rib cuts 202 begin proximate the forward end 206 of the jacket 204 and extend backwards toward the base 206. The rib cuts 202 are spaced equally apart about the outer circumference of the jacket 204. In preferred embodiments, the ventilation ports 30 are defined such that the ports do not intersect with the rib cuts 202. In alternative embodiments, the ventilation ports 30 may be defined to intersect with the rib cuts 202.

Figure 6:
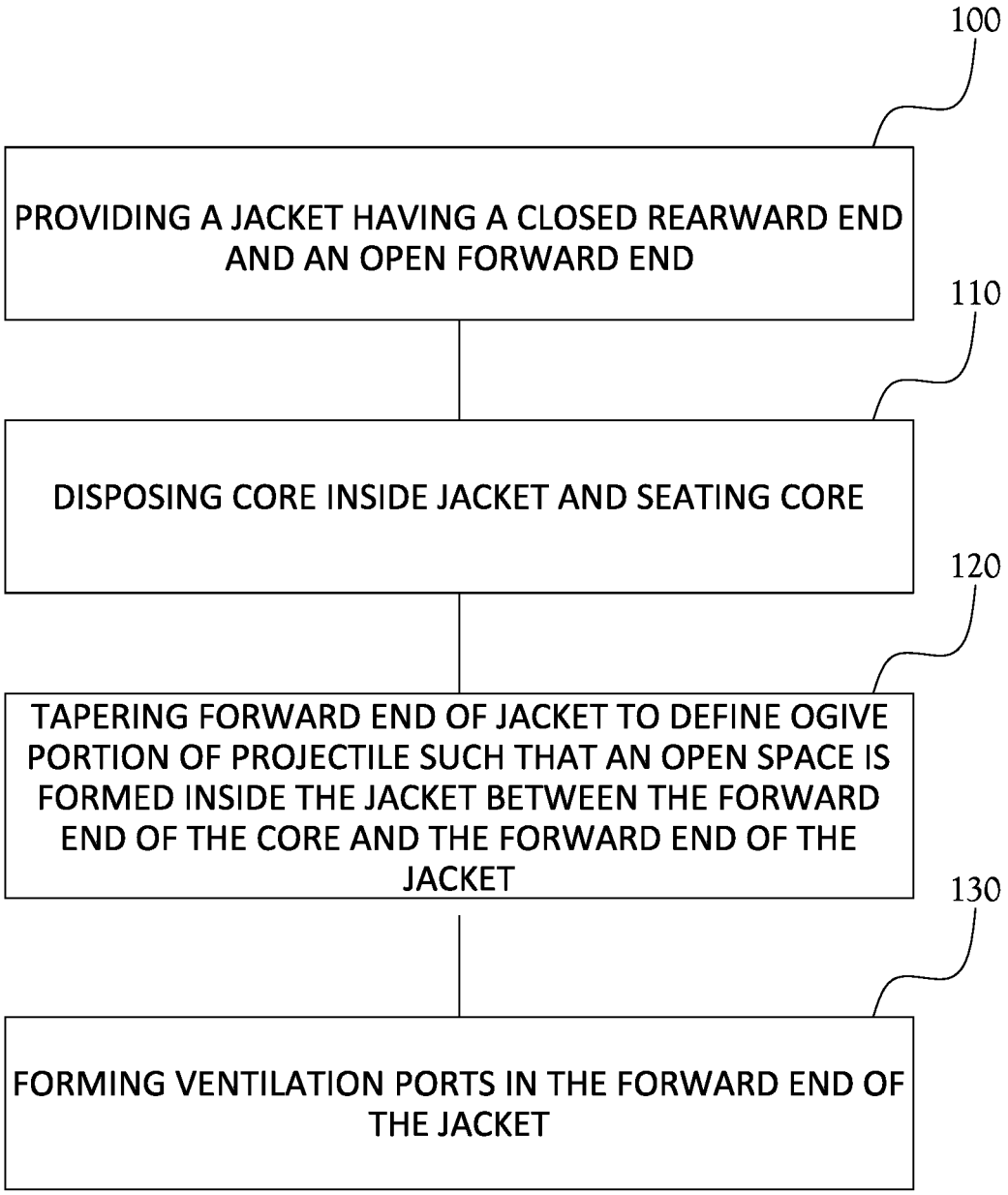
FIG. 6 illustrates a method of forming a ventilated projectile for use in a 15 firearm ammunition cartridge according to an example embodiment of the present general inventive concept.

FIG. 6 illustrates a method of forming a ventilated projectile for use in a firearm ammunition cartridge according to an example embodiment of the present general inventive concept. It is understood that the flow chart illustrating this method is simply one example embodiment of the present general inventive concept, and various other example embodiments may include more or fewer operations, and which may be performed in different orders and with various different components without departing from the scope of the present general inventive concept. In operation 100, a cylindrical copper jacket is provided that has a closed rearward end and an open forward end. In operation 110, a bullet core is disposed inside the jacket, and the core is seated in the bottom of the jacket. In operation 120, the jacket, along with the core seated inside, is shaped such that the bottom or base has the desired form, and the forward end is tapered to define the ogive portion of the projectile. In operation 130, a plurality of ventilation ports are formed in the forward end of the projectile so that air entering the hollow point of the projectile during flight may be vented out of the side of the jacket.

Various example embodiments of the present general inventive concept may provide a projectile for use in a firearm ammunition cartridge, the projectile including a core, a jacket in which the core is disposed, the jacket having a closed rearward end and an open forward end, the forward end tapering inwardly toward a longitudinal centerline of the jacket to define an ogive portion of the projectile, and extending past a forward end of the core to form an open space inside the jacket between the forward end of the core and the forward end of the jacket, and a plurality of ventilation ports formed proximate the forward end of the jacket, each of the ventilation ports having a first opening on an inner surface of the jacket defining the open space, and a second opening on an outer surface of the jacket. The plurality of ventilation ports may be spaced equidistantly from one another about the longitudinal centerline of the jacket. The ventilation ports may each have a longitudinal axis that angles back from the longitudinal centerline of the jacket. The first openings of the ventilation ports may be formed adjacent the forward end of the core. The ventilation ports may pass through a portion of the core. The core may be formed with material softer than the jacket. An outer surface of the jacket adjacent the forward end of the jacket may be continuous. The outer surface of the jacket adjacent the forward end may include a plurality of rib cuts extending back from the forward end to facilitate expansion of the jacket upon impact of the projectile. The ventilation ports may be arranged so as to not intersect the rib cuts. The jacket may be comprised of copper.

Various example embodiments of the present general inventive concept may provide a method of forming a projectile for use in a firearm ammunition cartridge, the method including providing a jacket having a closed rearward end and an open forward end, disposing a core inside the jacket, tapering the forward end of the jacket inwardly toward a longitudinal centerline of the jacket to define an ogive portion of the projectile such that the forward end of the jacket extends past a forward end of the core to form an open space inside the jacket between the forward end of the core and the forward end of the jacket, and forming a plurality of ventilation ports in the forward end of the jacket, each of the ventilation ports having a first opening on an inner surface of the jacket defining the open space, and a second opening on an outer surface of the jacket. The method may further include forming the plurality of ventilation ports so as to be spaced equidistantly from one another about the longitudinal centerline of the jacket. The method may further include forming the plurality of ventilation ports with a punch, drill, or laser. The method may further include forming the ventilation ports to each have a longitudinal axis that angles back from the longitudinal centerline of the jacket. The method may further include forming the first openings of the ventilation ports to be adjacent the forward end of the core. The method may further include forming the ventilation ports to pass through a portion of the core. The method may further include forming a plurality of rib cuts extending back from the forward end to facilitate expansion of the jacket upon impact of the projectile. The method may further include forming the ventilation ports so as to not intersect the rib cuts.

Various example embodiments of the present general inventive concept may provide a projectile for use in a firearm ammunition cartridge, the projectile including a core, a jacket in which the core is disposed, the jacket having a closed rearward end and an open forward end, the forward end tapering inwardly toward a longitudinal centerline of the jacket to define an ogive portion of the projectile, and extending past a forward end of the core to form an open space inside the jacket between the forward end of the core and the forward end of the jacket, and a plurality of ventilation ports formed proximate the forward end of the jacket, each of the ventilation ports having a first opening on a surface defining the open space, and a second opening on an outer surface of the jacket. The first opening of each of the ventilation ports may be formed on the forward end of the core.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A projectile for use in a firearm ammunition cartridge, the projectile comprising:

a core;

a monolithic jacket in which the core is disposed, the jacket having a closed rearward end and an open forward end, the forward end tapering inwardly toward a longitudinal centerline of the jacket to define an ogive portion of the projectile, and extending past a closed forward end of the core to form an open space inside the jacket between the closed forward end of the core and the forward end of the jacket; and a plurality of ventilation ports defined through the jacket proximate the forward end of the jacket, each of the ventilation ports having a first opening on an inner surface of the jacket defining the open space connected to a second opening on an outer surface of the jacket by a bore defined through the jacket.

2. The projectile of claim 1, wherein the plurality of ventilation ports are spaced equidistantly from one another about the longitudinal centerline of the jacket.

3. The projectile of claim 1, wherein the ventilation ports each have a longitudinal axis that angles back from the longitudinal centerline of the jacket.

4. The projectile of claim 1, wherein the first openings of the ventilation ports are formed adjacent the forward end of the core.

5. The projectile of claim 1, wherein the core is formed with material softer than the jacket.

6. The projectile of claim 1, wherein an outer surface of the jacket adjacent the forward end of the jacket is continuous.

7. The projectile of claim 1, wherein an outer surface of the jacket adjacent the forward end comprises a plurality of rib cuts extending back from the forward end to facilitate expansion of the jacket upon impact of the projectile.

8. The projectile of claim 7, wherein the ventilation ports are arranged so as to not intersect the rib cuts.

9. The projectile of claim 1, wherein the jacket is comprised of copper.

10. The projectile of claim 1, wherein the ventilation ports are configured to increase flight stability of the projectile by reducing the effects of air turbulence experienced at the open space.

11. A method of forming a projectile for use in a firearm ammunition cartridge, the method comprising:

providing a monolithic jacket having a closed rearward end and an open forward end;

disposing a core inside the jacket;

tapering the forward end of the jacket inwardly toward a longitudinal centerline of the jacket to define an ogive portion of the projectile such that the forward end of the jacket extends past a closed forward end of the core to form an open space inside the jacket between the closed forward end of the core and the forward end of the jacket; and forming a plurality of ventilation ports through the forward end of the jacket, each of the ventilation ports having a first opening on an inner surface of the jacket defining the open space connected to a second opening on an outer surface of the jacket by a bore defined through the jacket.

12. The method of claim 11, further comprising forming the plurality of ventilation ports so as to be spaced equidistantly from one another about the longitudinal centerline of the jacket.

13. The method of claim 11, further comprising forming the plurality of ventilation ports with a punch, drill, or laser.

14. The method of claim 11, further comprising forming the ventilation ports to each have a longitudinal axis that angles back from the longitudinal centerline of the jacket.

15. The method of claim 11, further comprising forming the first openings of the ventilation ports to be adjacent the forward end of the core.

16. The method of claim 11, further comprising forming a plurality of rib cuts extending back from the forward end to facilitate expansion of the jacket upon impact of the projectile.

17. The method of claim 16, further comprising forming the ventilation ports so as to not intersect the rib cuts.

* * * * *